US007439911B2

(12) United States Patent
Wang

(10) Patent No.: US 7,439,911 B2
(45) Date of Patent: Oct. 21, 2008

(54) SLOT AND MULTI-INVERTED-F COUPLING WIDEBAND ANTENNA AND ELECTRONIC DEVICE THEREOF

(75) Inventor: Chih-Ming Wang, Hsinchu (TW)

(73) Assignee: Wistron NeWeb Corp., Taipei Hsien (TW)

( * ) Notice: Subject to any disclaimer, the term of this patent is extended or adjusted under 35 U.S.C. 154(b) by 145 days.

(21) Appl. No.: 11/340,144

(22) Filed: Jan. 25, 2006

(65) Prior Publication Data

US 2007/0103367 A1 May 10, 2007

(30) Foreign Application Priority Data

Nov. 9, 2005 (TW) ..... 94139234 A

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS 6,812,892 B2 11/2004 Tai et al. ..... 343/700 MS
7,050,010 B2 * 5/2006 Wang et al. ..... 343/702
7,119,747 B2 * 10/2006 Lin et al. ..... 343/702
7,148,849 B2 * 12/2006 Lin ..... 343/700 MS
7,161,543 B2 * 1/2007 Cheng et al. ..... 343/702
7,212,161 B2 * 5/2007 Chen et al. ..... 343/700 MS
7,218,282 B2 * 5/2007 Humpfer et al. ..... 343/700 MS
2005/0190110 A1 * 9/2005 Taromaru et al. ..... 343/702
2006/0181464 A1 * 8/2006 Erkocevic ..... 343/702

* cited by examiner

*Primary Examiner*—HoangAnh T Le
(74) *Attorney, Agent, or Firm*—J.C. Patents

(57) ABSTRACT

A slot and multi-inverted-F coupling wideband antenna and an electronic device using the aforementioned wideband antenna are disclosed. The antenna includes at least a ground portion, a first radiation portion, a second radiation portion, a third radiation portion, a fine tuning metal portion, and a transmission cable. The first radiation portion is electrically coupled to the ground portion. The fine tuning metal portion is electrically coupled to the first radiation portion. The second radiation portion is electrically coupled to the fine tuning metal portion and forms a first inverted-F antenna with the first radiation portion. The third radiation portion is electrically coupled to the fine tuning metal portion and forms a second inverted-F antenna with the first radiation portion. The transmission cable is electrically coupled to one of the first radiation portion and the fine tuning metal portion.

24 Claims, 14 Drawing Sheets

701

| frequency | average value |
|---|---|
| 2300(MHz) | -2.21dB |
| 2350(MHz) | -2.09dB |
| 2400(MHz) | -2.07dB |
| 2442(MHz) | -1.93dB |
| 2484(MHz) | -2.39dB |
| 5150(MHz) | -1.55dB |
| 5250(MHz) | -1.49dB |
| 5350(MHz) | -2.18dB |
| 5470(MHz) | -2.30dB |
| 5600(MHz) | -2.09dB |
| 5725(MHz) | -1.87dB |
| 5850(MHz) | -2.28dB |

702

| frequency | average value |
|---|---|
| 2300(MHz) | -2.58dB |
| 2350(MHz) | -2.63dB |
| 2400(MHz) | -2.31dB |
| 2442(MHz) | -2.31dB |
| 2484(MHz) | -2.44dB |
| 5150(MHz) | -2.70dB |
| 5250(MHz) | -2.97dB |
| 5350(MHz) | -3.23dB |
| 5470(MHz) | -3.30dB |
| 5600(MHz) | -2.42dB |
| 5725(MHz) | -2.95dB |
| 5850(MHz) | -3.54dB |

FIG. 7B

SLOT AND MULTI-INVERTED-F COUPLING WIDEBAND ANTENNA AND ELECTRONIC DEVICE THEREOF

CROSS-REFERENCE TO RELATED APPLICATION

This application claims the priority benefit of Taiwan application Ser. No. 94139234, filed on Nov. 9, 2005. All disclosure of the Taiwan application is incorporated herein by reference.

BACKGROUND OF THE INVENTION

1. Field of Invention

The present invention relates to an antenna. More particularly, the present invention relates to a slot and multi-inverted-F coupling wideband antenna and an electronic device thereof.

2. Description of Related Art

In keeping pace with progress in telecommunication technology, application of the telecommunication technology for hi-tech products has been increasing and related telecommunication products have become diversified. In recent years, the consumer functional requirements for telecommunication products have become increasingly higher; therefore, telecommunication products with various designs and functions are continuously brought to market, such as the design consolidation of telecommunication products with dual-band and triple-band, the computer network products with wireless networks are in demand. In addition, due to the maturity of integrated circuit technologies, the trend for products is leading towards lighter, thinner, and smaller.

In telecommunication products, the main function of an antennas is for transmitting and receiving signals. Today, as the trend for products is towards lighter, thinner, and smaller, the inverted-F antennas have become more popular in the market. FIG. 1 is a structural schematic diagram of a conventional inverted-F antenna. The antenna mainly includes a radiator 101, a ground plate 102, and a signal source 103. In addition, an antenna length 104 is also shown in FIG. 1. Because the radiator 101 and the signal source 103 form a shape of an inverted F, it is called an inverted-F antenna. The aforementioned type of antenna mainly makes use of the principle of current excitation.

In addition, Hon Hai Precision Industry Co. Ltd has presented a dual frequency antenna under a U.S. Pat. No. 6,812,892. FIG. 2 is a structural schematic diagram of a conventional dual frequency inverted-F antenna under the U.S. Pat. No. 6,812,892. The antenna includes two inverted-F antennas, which are illustrated in FIG. 2 as the first inverted-F antenna 201 and the second inverted-F antenna 202. Two radiators 204 and 205 are extended from the tail end of the original inverted-F antenna, so that a dual inverted-F antenna is formed. In which, the shorter antenna 202 is used for receiving higher frequency signals such as 5.2 GHz signals under radio communication protocol 802.11a while the longer antenna 201 is used for receiving lower frequency signals such as 2.45 GHz signals under radio communication protocol 802.11b.

FIG. 3 is the voltage standing wave ratio (VSWR) diagram of the aforementioned conventional antenna in FIG. 2. As can be determined from FIG. 3, the lower range operating frequency of the antenna is around 2.45 GHz while the higher range operating frequency is around 5 GHz to 6 GHz. However, based on modern applications, for example, the Worldwide Interoperability for Microwave Access (WIMAX) brought forward by Intel Co. requires a bandwidth between 2.3 GHz to 2.5 GHz. The antenna in FIG. 2 cannot provide such a large bandwidth.

SUMMARY OF THE INVENTION

Accordingly, the present invention is directed to provide a slot and multi-inverted-F coupling wideband antenna with a wider bandwidth.

The present invention provides a slot and multi-inverted-F coupling wideband antenna including at least a ground portion, a first radiation portion, a fine tuning metal portion, a second radiation portion, a third radiation portion, and a transmission cable. The first radiation portion is electrically coupled to the ground portion. The fine tuning metal portion is electrically coupled to the first radiation portion. The second radiation portion is electrically coupled to the fine tuning metal portion and is formed a first inverted-F antenna with the first radiation portion. The third radiation portion is electrically coupled to the fine tuning metal portion and is formed a second inverted-F antenna with the first radiation portion. In addition, the transmission cable is selectively electrically coupled to the first radiation portion and the fine tuning metal portion.

According to the slot and multi-inverted-F coupling wideband antenna of an embodiment of the present invention, the aforementioned second radiation portion and the third radiation portion are parallel with each other, which causes a coupling effect and forms a wideband antenna.

The present invention provides an electronic device, which includes an antenna including a ground portion, a first radiation portion, a fine tuning metal portion, a second radiation portion, a third radiation portion, and a transmission cable. The first radiation portion is electrically coupled to the ground portion. The fine tuning metal portion is electrically coupled to the first radiation portion. The second radiation portion is electrically coupled to the fine tuning metal portion and is formed a first inverted-F antenna with the first radiation portion. The third radiation portion is electrically coupled to the fine tuning metal portion and is formed a second inverted-F antenna with the first radiation portion. In addition, the transmission cable is selectively electrically coupled to the first radiation portion and the fine tuning metal portion.

According to the electronic device of an embodiment of the present invention, the aforementioned second radiation portion and the third radiation portion are parallel with each other, which causes a coupling effect and forms a wideband antenna.

The present invention has adopted the second radiation portion and the third radiation portion to respectively receive and transmit signals whose broadcast bands are close to each other, so that the bandwidth received and transmitted by the antenna is wider. The slot (flat) antenna produced by the signal source and the first radiator can receive and transmit the signals of another broadcast band. The metal plate electrically coupled to the first radiator can adjust the impedance matching of the slot (flat) antenna.

In order to make the aforementioned and other objects, features and advantages of the present invention comprehensible, an embodiment accompanied with figures is described in detail below.

BRIEF DESCRIPTION OF THE DRAWINGS

FIG. 7B is a data diagram of the radiation field intensity of the horizontal section of the antenna shown in FIG. 5A of the embodiment of the present invention and the radiation field intensity of the horizontal section of the conventional antenna shown in FIG. 2.

DESCRIPTION OF THE EMBODIMENTS

Figure 1:
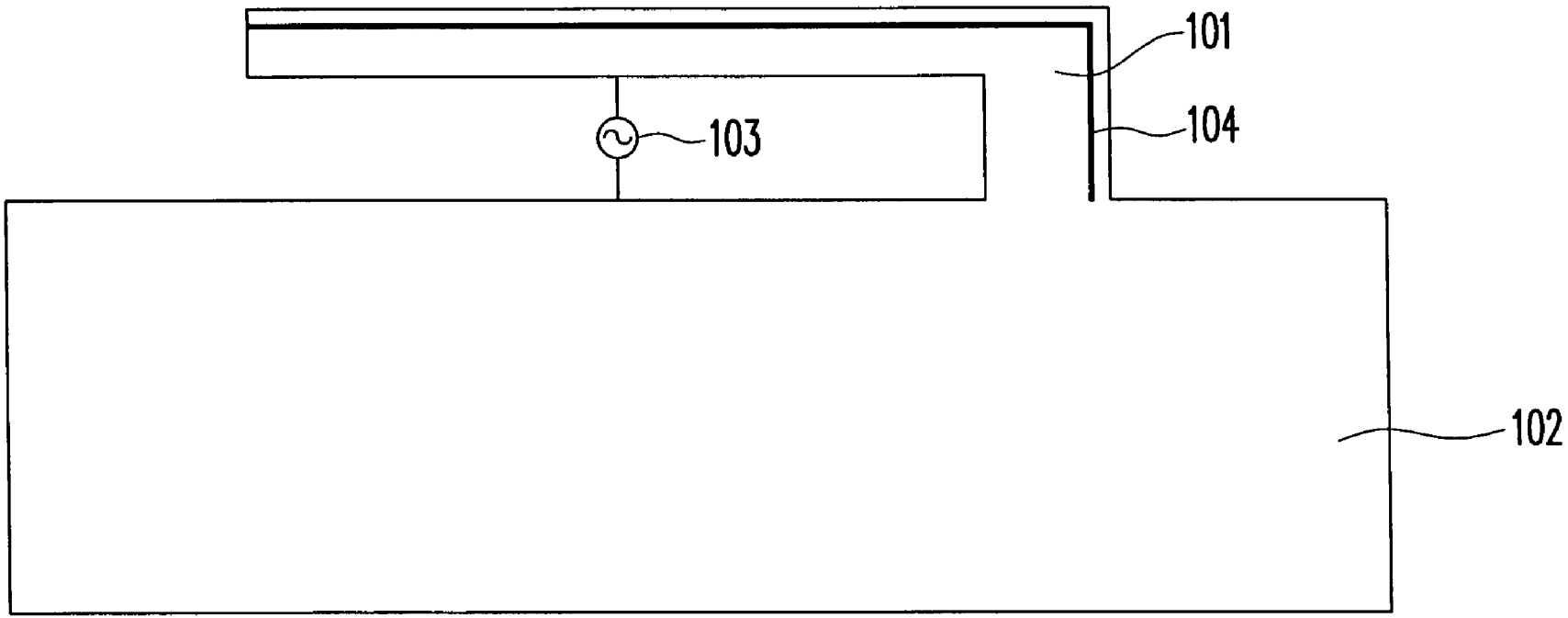
FIG. 1 (PRIOR ART)
FIG. 1 is a structural schematic diagram of a conventional inverted-F antenna.

Meeting the requirements of modern science and technology for wideband and multiband, the present invention provides a slot and multi-inverted-F coupling wideband antenna. The antenna can transmit and receive a wider bandwidth in a designated bandwidth. In addition, the antenna can be used in a plurality of bandwidths. In the following, an embodiment of the present invention is described with the accompanying drawings.

FIGS. 4A, 4B, 4C, and 4D illustrate a slot and multi-inverted-F coupling wideband antenna of an embodiment of the present invention. FIG. 4E illustrates an electronic device using the aforementioned antenna. Referring to FIGS. 4A, 4B, 4C, 4D, and 4E, the electronic device includes the aforementioned antenna 40*a* and a RF signal transmission device 41*a*. The electronic device is, for example, a notebook computer; the antenna 40*a* is, for example, disposed on two sides of the panel of the notebook computer (Referring to FIG. 4E). Through the transmission cable 42*a* of the antenna, the RF signal transmission device 41*a* is used for processing the signals received by the antenna 40*a* or transmitting the signals to the antenna 40*a* for radiating. Those skilled in the art should know that the electronic device can also be a PDA, a wireless ethernet adapter, a wireless router, etc.

The antenna 40*a* includes a ground portion 400, a first radiation portion 401, a fine tuning metal portion 402, a second radiation portion 403, a third radiation portion 404, and a transmission cable 405. The first radiation portion 401 is electrically coupled to the ground portion 400. The fine tuning metal portion 402 is electrically coupled to the first radiation portion 401. The second radiation portion 403 is electrically coupled to the fine tuning metal portion 402. The third radiation portion 404 is electrically coupled to the fine tuning metal portion 402. The transmission cable 405 is electrically coupled to the first radiation portion 401. In this embodiment, there is a bump 406 on the contact where the transmission cable 405 is electrically coupled to the first radiation portion 401. The bump 406 is used to fool-proof by the manufacturers. In addition, the transmission cable 405 used in the present embodiment is a mini coaxial cable.

Figure 4A:
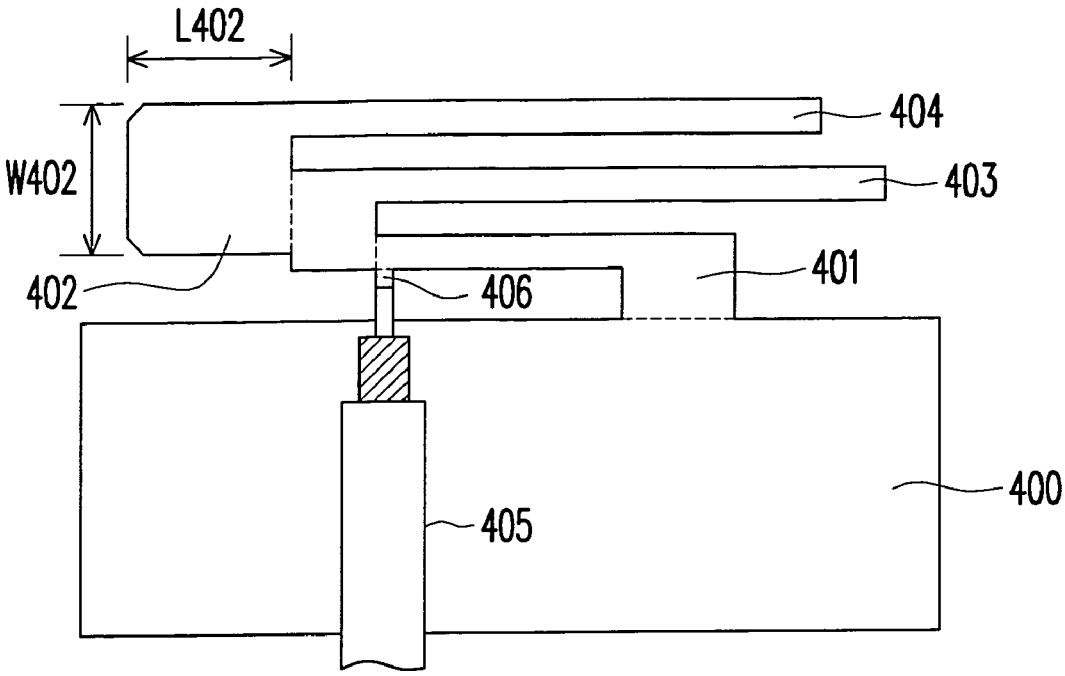
FIGS. 4A, 4B, 4C, and 4D illustrate a slot and multi-inverted-F coupling wideband antenna according to an embodiment of the present invention.
Figure 4B:
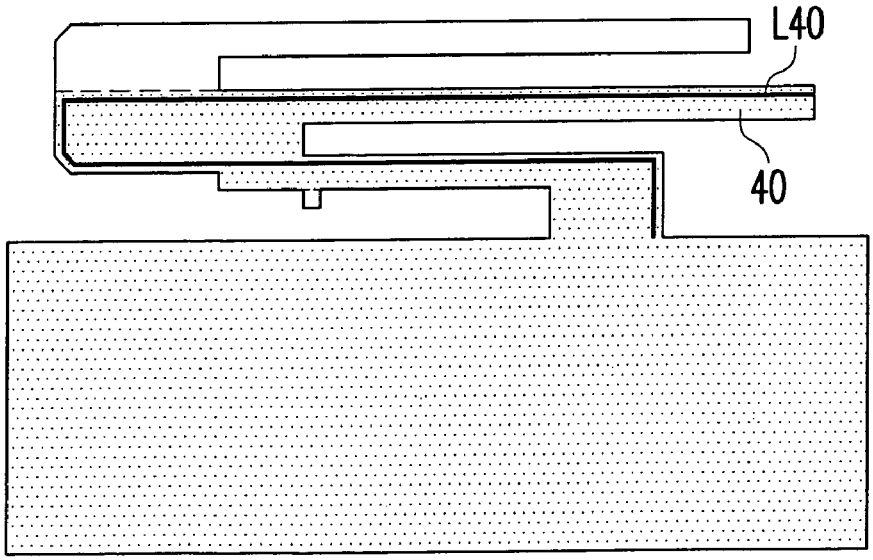
Figure 4C:
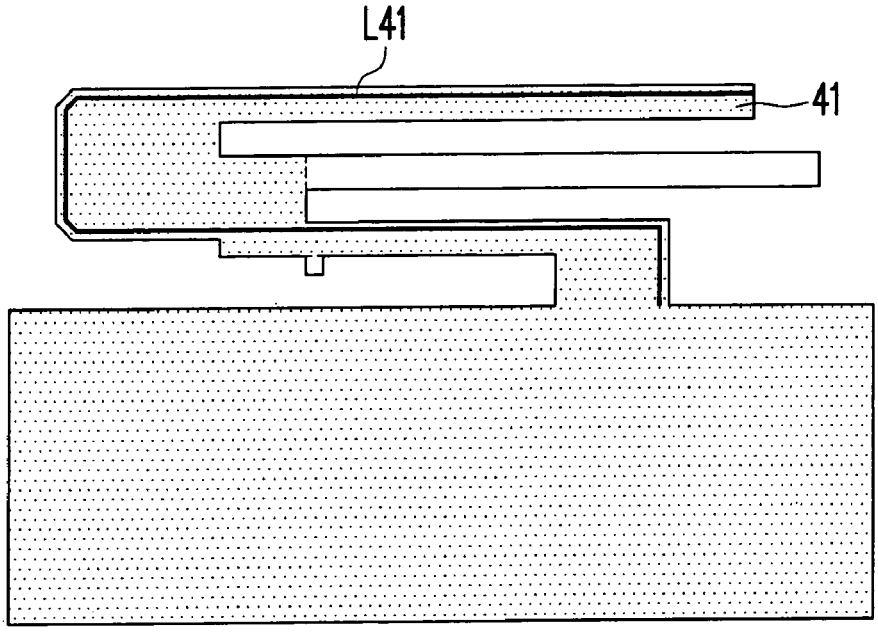
Figure 4D:
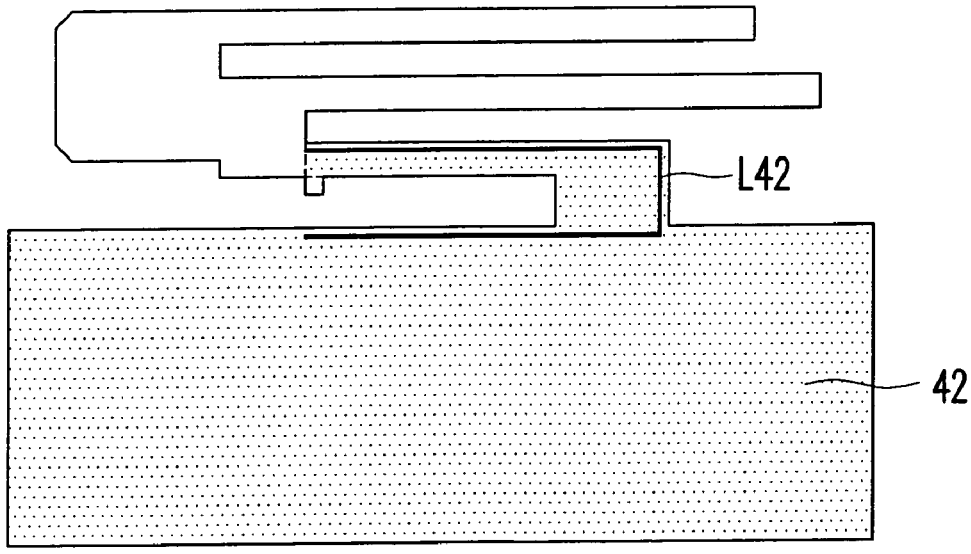
Figure 4E:
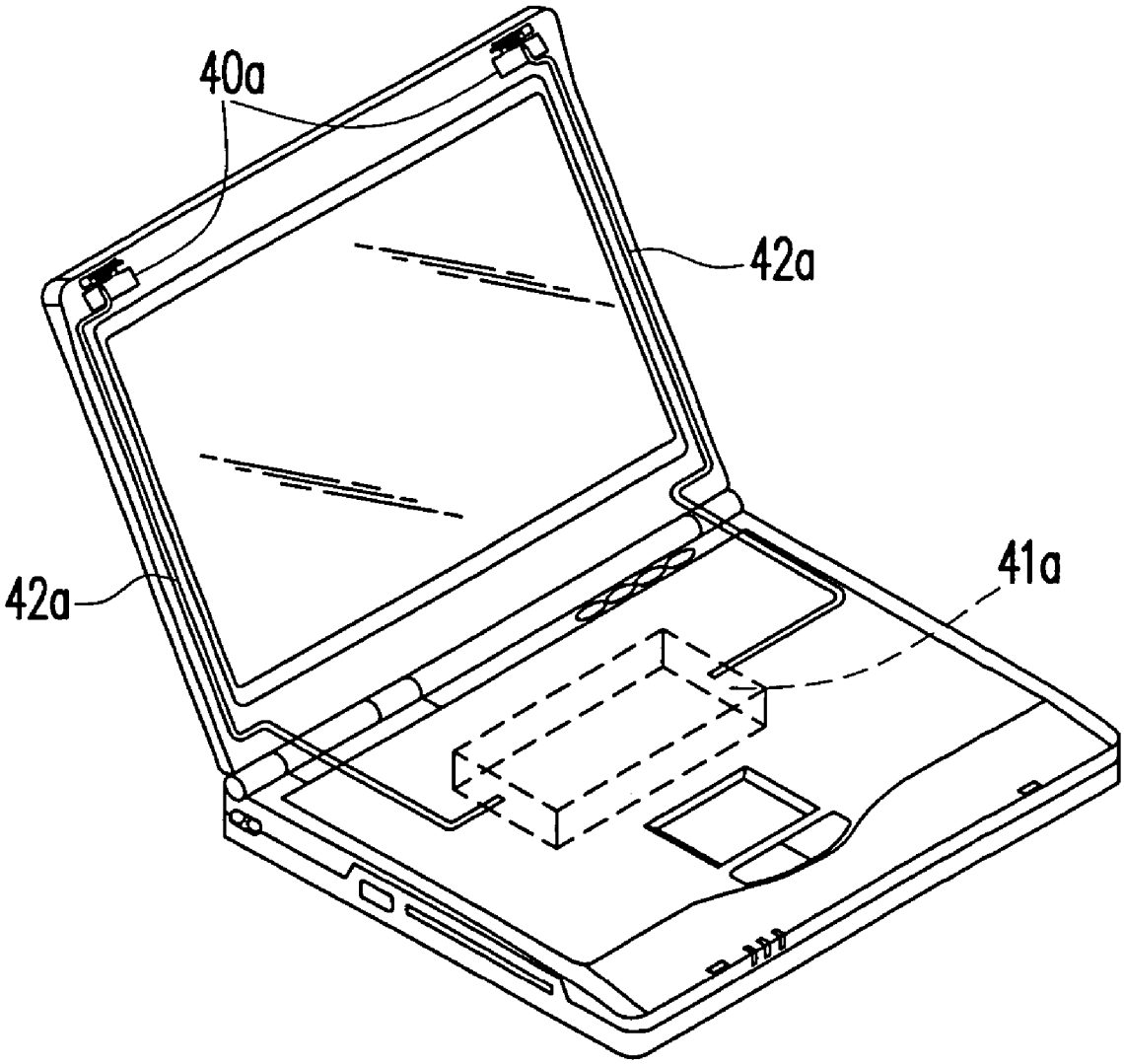
FIG. 4E illustrates an electronic device using the antenna according to the embodiment shown in FIGS. 4A, 4B, 4C, and 4D.

In the antenna drawings FIGS. 4B, 4C and 4D, it is evident that the antenna includes a first inverted-F antenna 40 and a second inverted-F antenna 41 using electric current excitation, and a slot antenna 42 using magnetic field excitation. In this embodiment, the first inverted-F antenna 40 and the second inverted-F antenna 41 are respectively used for receiving signals of the bands of 2.3 GHz and 2.5 GHz, while the slot antenna 42 is used for receiving signals of the bands from 5 GHz to 6 GHz. An overall length L40 of the first inverted-F antenna 40 is illustrated in FIG. 4. An overall length L41 of the second inverted-F antenna 41 is illustrated in FIG. 4. In addition, an overall length L42 of the slot antenna 42 is illustrated in FIG. 4.

Here an assumption is made for the embodiment in FIG. 4. First, it is assumed that the first inverted-F antenna 40 is used for receiving signals of the band of 2.3 GHz and the second inverted-F antenna 41 is used to receive signals of the band of 2.5 GHz. Thus, the length of the first inverted-F antenna 40 is a slightly longer than the second inverted-F antenna 41. In the embodiment, the second radiation portion 403 is designed at about 1% to 2% of the 2.4 GHz signal wavelength longer than the third radiation portion 404, namely from 0.125 cm to 0.25 cm. Here, the second radiation portion 403 can be designed close to and parallel with the third radiation portion 404, so that the first inverted-F antenna 40 and the second inverted-F antenna 41 produce a coupling effect to form a wideband antenna which can transmit and receive signals in the 2.2 GHz to 2.6 GHz range.

According to the foregoing embodiment of the present invention, those skilled in the art should be well aware that if the above assumption is changed to that the first inverted-F antenna 40 to be used for receiving signals of the band of 2.5 GHz and the second inverted-F antenna 41 to be used to receive signals of the band of 2.3 GHz, the length of the first inverted-F antenna 40 is slightly shorter than the second inverted-F antenna 41, and the third radiation portion 404 is designed at about 1% to 2% of the 2.4 GHz signal wavelength longer than the second radiation portion 403. In the same way, the first inverted-F antenna 40 and the second inverted-F antenna 41 also produce a coupling effect to form a wideband antenna.

In addition, the fine tuning metal portion 402 can be used for adjusting the impedance matching of the slot antenna 42. A width W402 of the fine tuning metal portion 402 can adjust the change of the field form of the horizontal radiation pattern. The wider the width W402 is, the stronger the radiation energy becomes. In addition, when the length L402 of the fine tuning metal portion 402 is longer, the lengths L40 and L41 of the first inverted-F antenna 40 and the second inverted-F antenna 41 correspondingly become longer; therefore, the frequencies of the signals that the first inverted-F antenna 40 and the second inverted-F antenna 41 can transmit and receive are also decreased correspondingly.

Figure 5A:
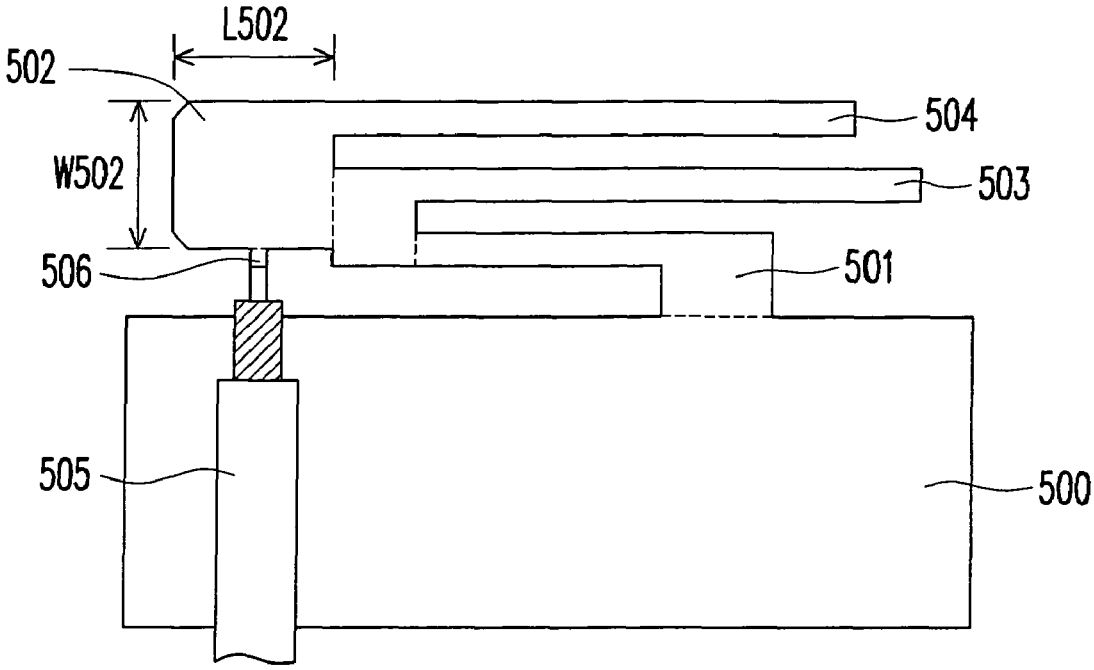
FIGS. 5A, 5B, 5C, 5D, and 5E illustrate a slot and multi-inverted-F coupling wideband antenna according to an embodiment of the present invention.

FIGS. 5A, 5B, 5C, 5D, and 5E respectively illustrate a slot and multi-inverted-F coupling wideband antenna according to an embodiment of the present invention. FIG. 5F illustrates an electronic device using the antenna of the above embodiment. Referring to FIGS. 5A, 5B, 5C, 5D, and 5F, in which the electronic device includes an antenna 50*a* and the RF signal transmission device 51*a* of the foregoing embodiment of the present invention. Giving an example with a notebook computer for this electronic device, the antenna 50*a* is for example disposed on two sides of the panel of the notebook computer (Referring to FIG. 5F). Through the transmission cable 52*a* of the antenna 50*a*, the RF signal transmission device 51*a* processes the signals received by the antenna 50*a* or transmits the signals to the antenna 50*a* to radiate. Those skilled in the art should be well aware that the electronic device can also be a PDA, a wireless network adapter, a wireless router, etc.

The antenna 50*a* includes a ground portion 500, a first radiation portion 501, a fine tuning metal portion 502, a second radiation portion 503, a third radiation portion 504, and a transmission cable 505. The first radiation portion 501 is electrically coupled to the ground portion 500. The fine tuning metal portion 502 is electrically coupled to the first radiation portion 501. The second radiation portion 503 is electrically coupled to the fine tuning metal portion 502. The third radiation portion 504 is electrically coupled to the fine tuning metal portion 502. The transmission cable 505 is electrically coupled to the fine tuning metal portion 502. In addition, in this embodiment, a bump 506 is laid on a contact where the transmission cable 505 is electrically coupled to the fine tuning metal portion 502. The bump 506 is used by the manufacturers for fool-proof.

Figure 5B:
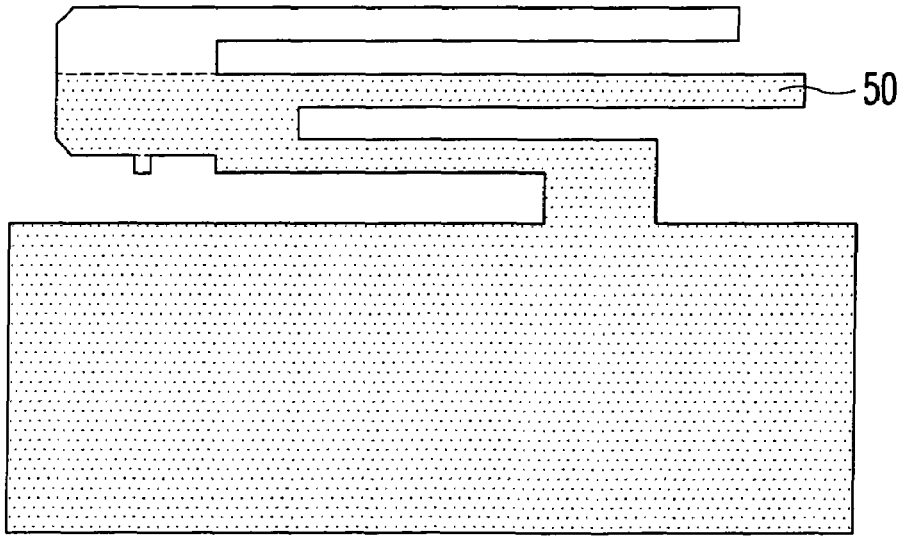
Figure 5C:
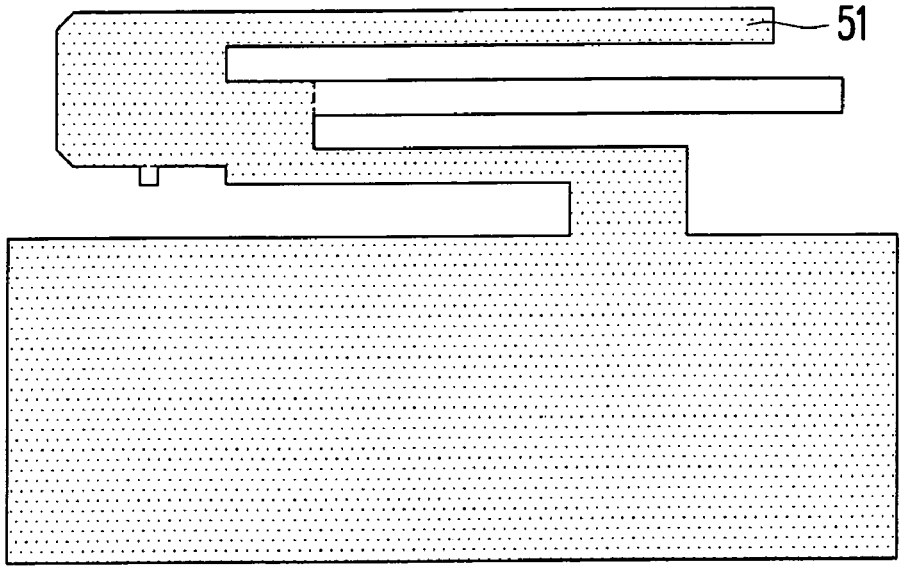
Figure 5D:
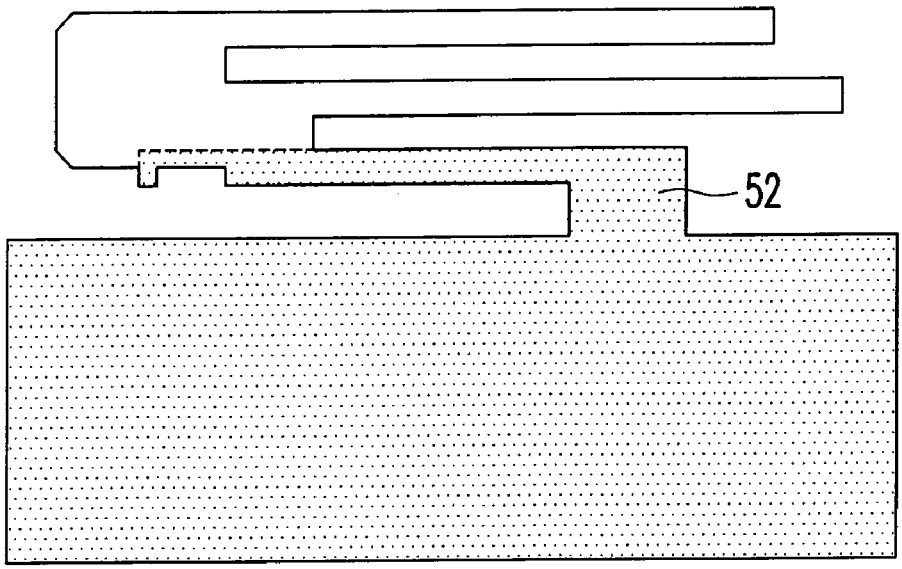
Figure 5E:
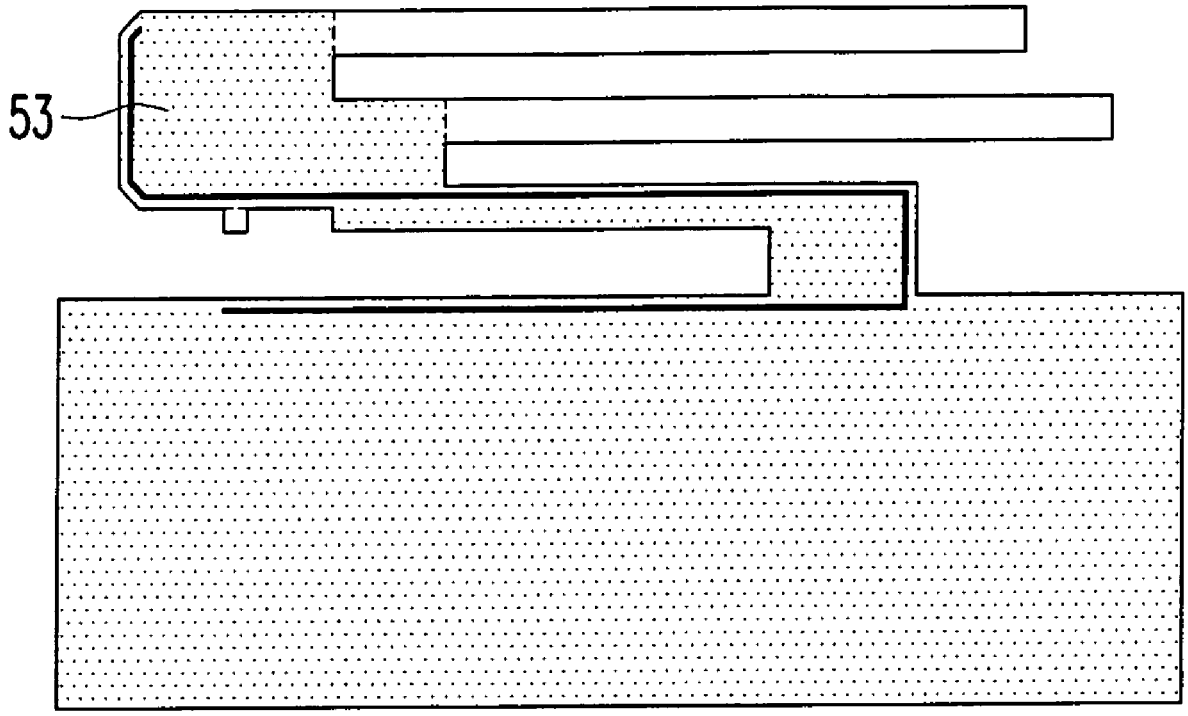
Figure 5F:
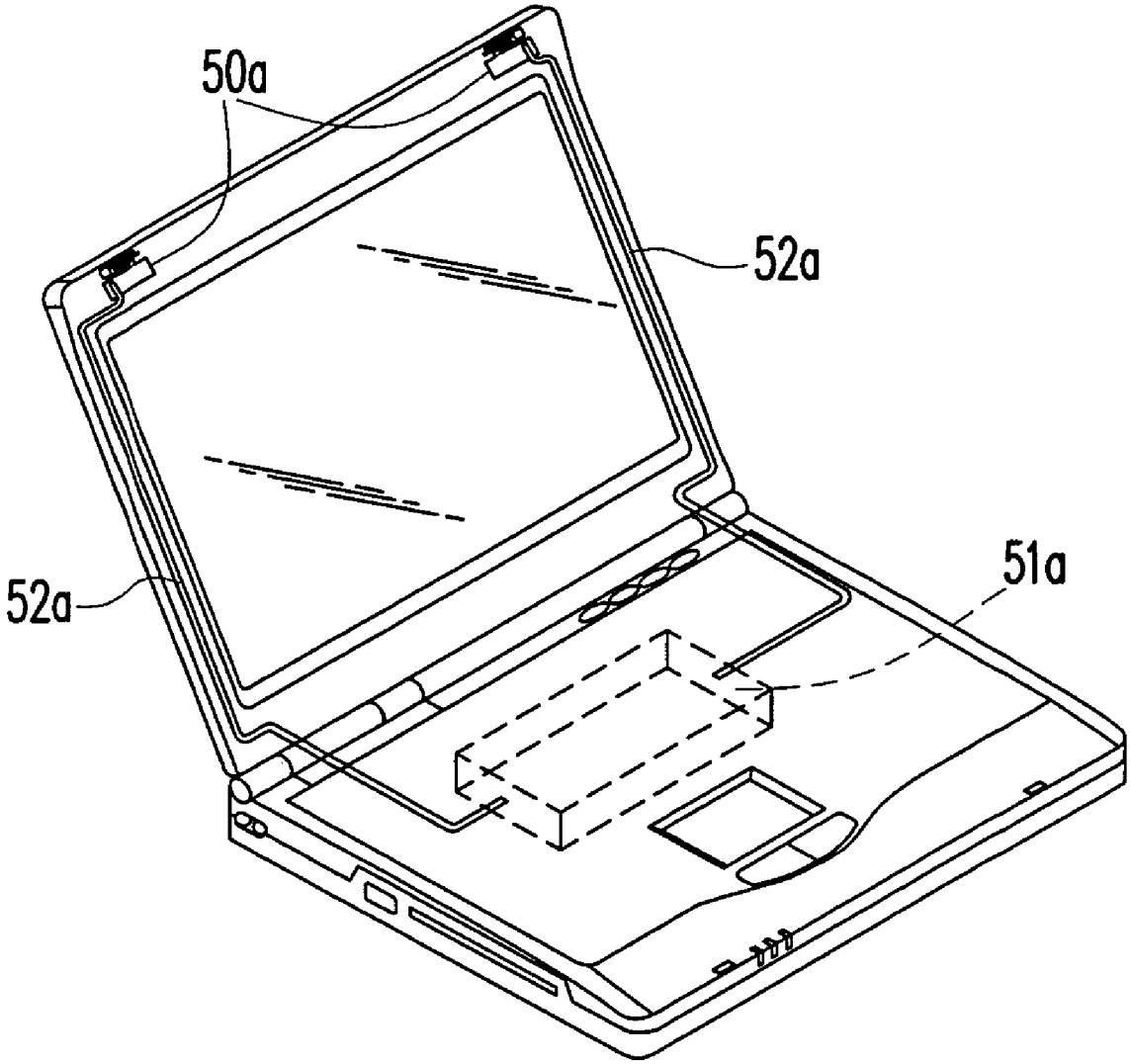
FIG. 5F illustrates an electronic device using the antenna according to the embodiment shown in FIGS. 5A, 5B, 5C, 5D, and 5E.

In the same way, the embodiment of the antenna 50*a* includes three antennas: a first inverted-F antenna 50 as in FIG. 5B, a second inverted-F antenna 51 as in FIG. 5C, and a slot antenna 52 as in FIG. 5D. The principle of the antenna 50*a* is similar to that of the embodiment shown in FIGS. 4A, 4B, 4C, and 4D, thus further descriptions are not needed. However, in addition to the method of operation of the slot antenna 52 shown in FIG. 5D, the antenna can also be of the form of the slot flat antenna 53 shown in FIG. 5E, whose length L53 is shown in FIG. 5E. The fine tuning metal portion 502 of this embodiment is the same as the one shown in FIGS. 4A, 4B, 4C, and 4D, whose length L502 and width W502 can be used for adjusting the parameters of the antenna. For example, the length of L502 becoming longer would result in a decrease of the frequencies of the first inverted-F antenna 50 and the second inverted-F antenna 51; the wider the width W502, the stronger the radiation energy becomes. However, in the embodiment of the slot flat antenna 53 shown in FIG. 5E, upon the length L502 becomes longer or the width W502 becomes wider, the frequency of the signals transmitted and received by the slot flat antenna 53 would be decreased.

In addition, the first inverted-F antenna 50 and the second inverted-F antenna 51 in the embodiment form a wideband antenna due to the coupling effect, whose method of operation is the same as the embodiment in FIG. 4 above.

Figure 6:
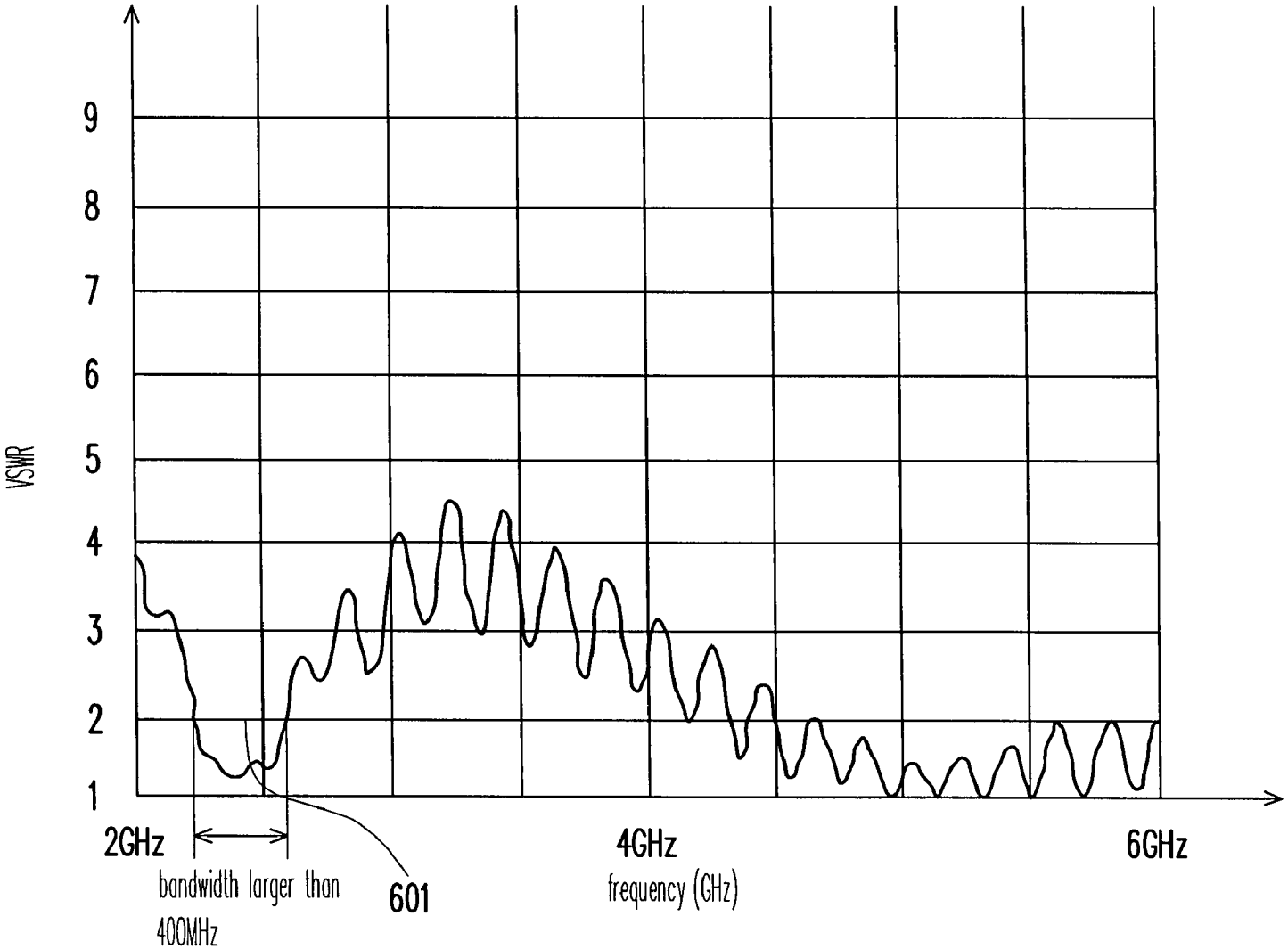
FIG. 6 is a VSWR diagram of the antenna according to the embodiment of the present invention shown in FIG. 5A.

FIG. 6 is a VSWR diagram of the antenna 50*a* of the embodiment of the present invention shown in FIG. 5A. Referring to FIG. 6, generally, based on the industrial standard of antennas for common personal computers and notebook computers, the VSWR is less than or equal to two. According to the above standard, antennas can receive high quality signals within a given band. Therefore, from a portion 601 shown in FIG. 6, it is obvious that because of the coupling effect produced by the second and third radiation portions of the embodiment of the present invention, the wideband antenna has a bandwidth of more that 400 MHz. As to the industry standard of antenna of Portable Digital Assistant (PDA), the preferred VSWR is less than or equal to three, thus a wider bandwidth can be achieved according to the antenna 50*a* of the embodiment of the present invention.

Figure 2:
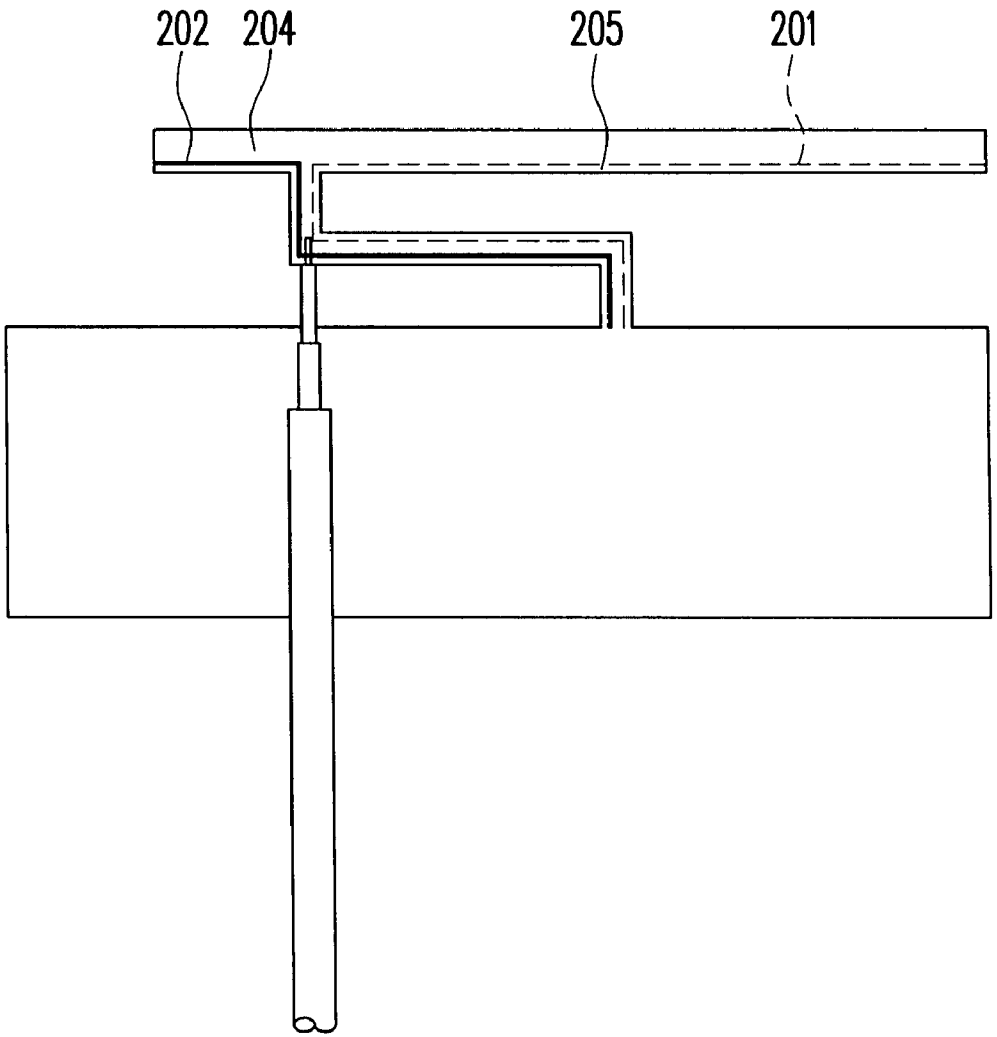
FIG. 2 (PRIOR ART)
FIG. 2 is a structural schematic diagram of a conventional dual frequency inverted-F antenna of U.S. Pat. No. 6,812,892.
Figure 3:
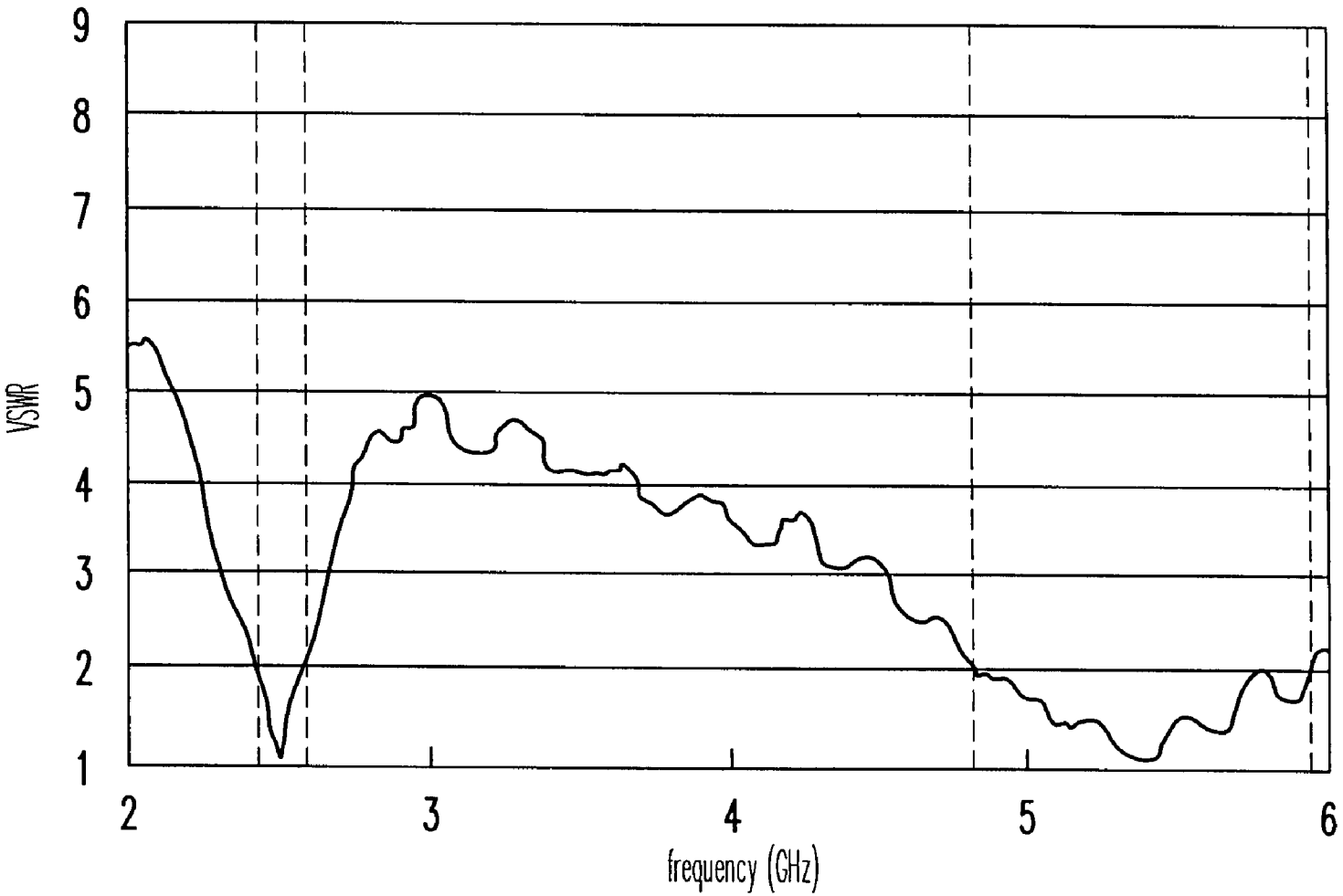
FIG. 3 (PRIOR ART)
FIG. 3 is a VSWR diagram of the conventional antenna in FIG. 2.
Figure 7A:
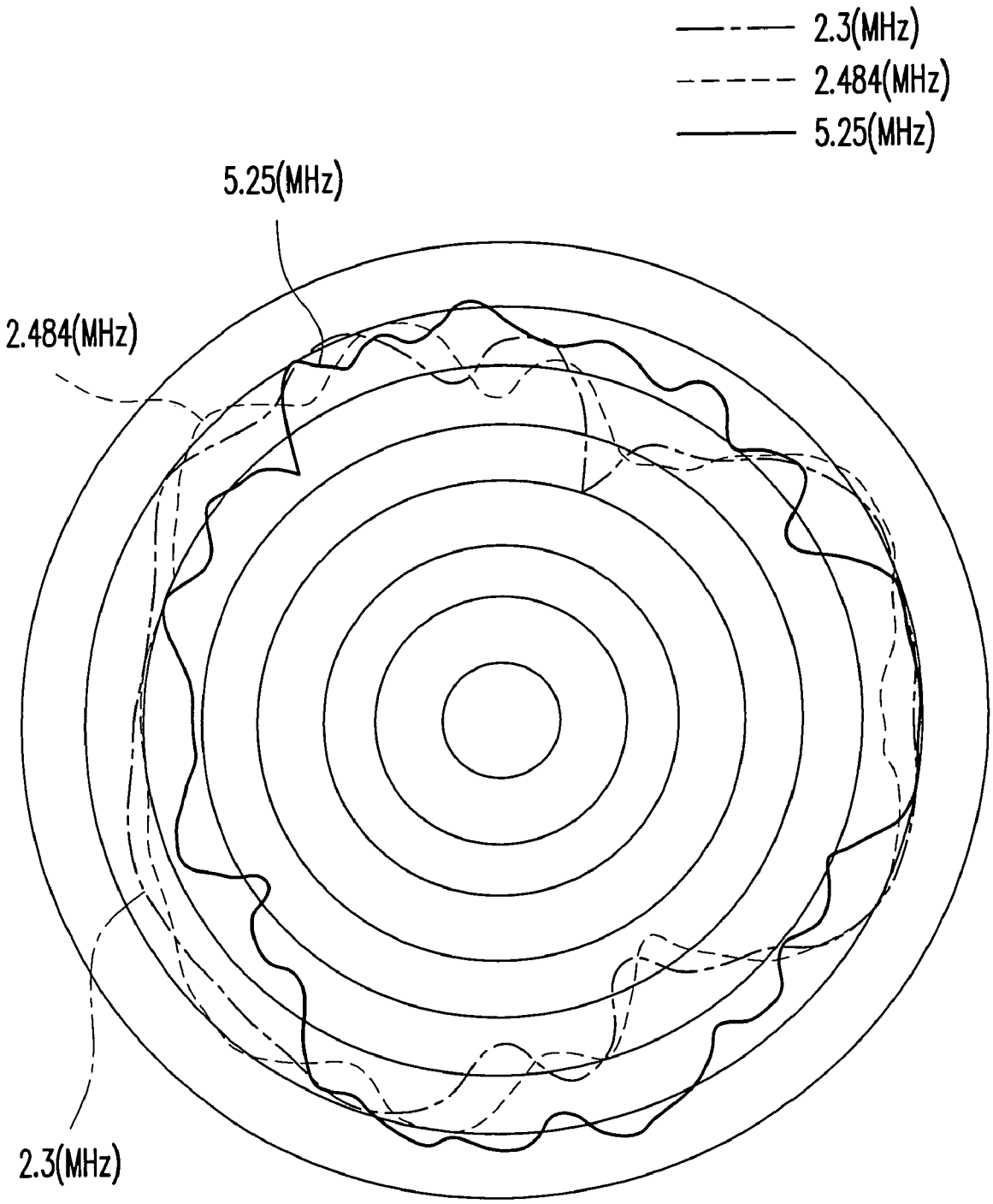
FIG. 7A is diagram of a horizontal radiation pattern of the antenna according to the embodiment of the present invention shown in FIG. 5A.

FIG. 7A is a diagram of a horizontal radiation pattern of the antenna 50*a* of the embodiment of the present invention shown in FIG. 5A. FIG. 7B is a data diagram of the radiation field intensity of the horizontal section of the antenna shown in FIG. 5A of the embodiment of the present invention and the radiation field intensity of the horizontal section of the conventional antenna shown in FIG. 2. From FIG. 7A, it can be seen that the antenna 50*a* of the embodiment of the present invention is an omnidirectional antenna. By comparing a testing result 701 of the embodiment of the present invention and a testing result 702 of the conventional antenna shown in FIG. 2, it can be seen that the average intensity of the radiation field of the antenna 50*a* of the embodiment of the present invention is higher than the one of the conventional antenna shown in FIG. 2 when they are applied in the same band.

Figure 8:
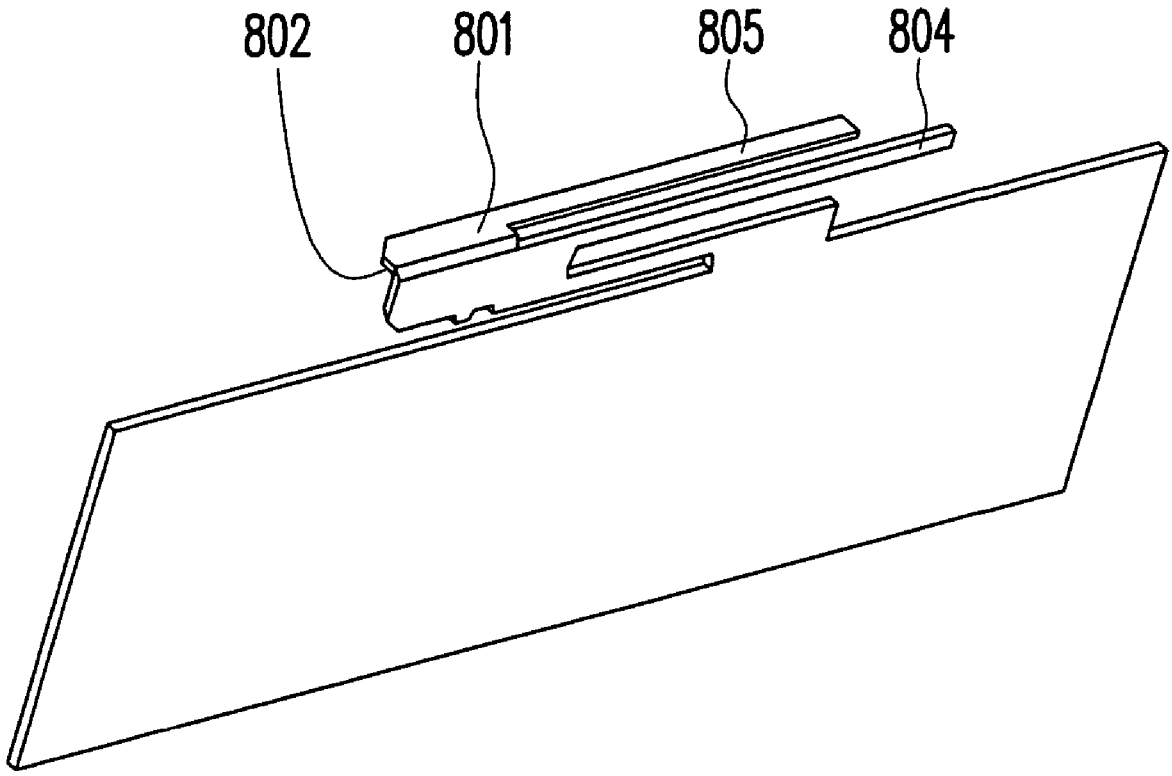
FIG. 8 is a perspective view of the slot and multi-inverted-F coupling wideband antenna according to an embodiment of the present invention.

FIG. 8 is a perspective view of the slot and multi-inverted-F coupling wideband antenna according to an embodiment of the present invention. In the embodiment, the fine tuning metal portion 801 has a bent edge 802, whose center line is parallel with the second radiation portion 804 and is disposed between the second radiation portion 804 and the third radiation portion 805. Using the above structure, the height of the antenna 50*a* can further be decreased. In modern products, such as notebook computers, the overall frames of the liquid crystal panels have become thinner and thinner. If the antennas required to be built into the frames of the liquid crystal panels, the length of the antennas must be sufficiently short. In this regard, the aforementioned embodiment could be used. Those skilled in the art, in reference to the embodiment of the present invention, should be aware that the bent edge can also be made between the first radiation portion and the second radiation portion, or between the first radiation portion and the ground portion for reducing the height of the antenna of the present invention.

In summary, the present invention uses the second radiation portion and the third radiation portion to respectively receive and transmit signals whose bands are tighter to each other, so that the bandwidth received and transmitted by the antenna is wider. The slot (flat) antenna formed by the signal source and the first radiator can receive and transmit the signals of another band. The metal plate electrically coupled with the first radiator can adjust the impedance matching of the slot (flat) antenna.

The present invention is disclosed above with its preferred embodiments. It is to be understood that the preferred embodiment of present invention is not to be taken in a limiting sense. It will be apparent to those skilled in the art that various modifications and variations can be made to the structure of the present invention without departing from the scope or spirit of the invention. The protection scope of the present invention is in accordant with the scope of the following claims and their equivalents.

What is claimed is:

1. A slot and multi-inverted-F coupling wideband antenna, comprising:

a ground portion;

a first radiation portion, having a first end coupled to the ground portion and an opposite second end away from the first end;

a fine tuning metal portion, coupled to the second end of the first radiation portion;

a second radiation portion, coupled to the fine tuning metal portion, extending in a direction from the second end to the first end of the first radiation portion, and forming a first inverted-F antenna with the first radiation portion;

a third radiation portion, coupled to the fining tune metal portion, extending in the same direction of the second radiation portion, and form a second inverted-F antenna with the first radiation portion; and a transmission cable, coupled to one of the first radiation portion and the fine tuning metal portion.

2. The slot and multi-inverted-F coupling wideband antenna as claimed in claim 1, wherein when the transmission cable feeds in signals from the first radiation portion, the first radiation portion and the ground portion form a slot antenna.

3. The slot and multi-inverted-F coupling wideband antenna as claimed in claim 2, wherein the area of the fine tuning metal portion is used for adjusting the impedance matching of the slot antenna.

4. The slot and multi-inverted-F coupling wideband antenna as claimed in claim 2, wherein the operating bandwidth of the slot antenna is between 5 GHz to 6 GHz.

5. The slot and multi-inverted-F coupling wideband antenna as claimed in claim 1, wherein when the transmission cable feeds in the signals from the fine tuning metal portion, the fine tuning metal portion, the first radiation portion, and the ground portion form a slot flat antenna.

6. The slot and multi-inverted-F coupling wideband antenna as claimed in claim 5, wherein the area of the fine tuning metal portion is used for adjusting the impedance matching of the slot flat antenna.

7. The slot and multi-inverted-F coupling wideband antenna as claimed in claim 5, wherein the operating bandwidth of the slot flat antenna is between 5 GHz to 6 GHz.

8. The slot and multi-inverted-F coupling wideband antenna as claimed in claim 1, wherein a plurality of extensions of the second radiation portion and the third radiation portion are parallel with each other.

9. The slot and multi-inverted-F coupling wideband antenna as claimed in claim 8, wherein the difference in the lengths of the second radiation portion and the third radiation portion is based on up to 1 to 2 percent more or less than the average wavelengths of the signals transmitted and received by the second radiation portion and the third radiation portion.

10. The slot and multi-inverted-F coupling wideband antenna as claimed in claim 1, the operating bandwidth of the first inverted-F antenna and the second inverted-F antenna is from 2.2 GHz to 2.6 GHz.

11. The slot and multi-inverted-F coupling wideband antenna as claimed in claim 1, wherein the transmission cable is a mini coaxial cable.

12. The slot and multi-inverted-F coupling wideband antenna as claimed in claim 1, wherein the transmission cable is connected between the first end and the second end of the first radiation portion.

13. An electronic device, comprising:

a ground portion;

a first radiation portion, having a first end coupled to the ground portion and an opposite second end away from the first distal end;

a fine tuning metal portion, coupled to the second end of the first radiation portion;

a second radiation portion, coupled to the fine tuning metal portion, extending in a direction from the second end to the first end of the first radiation portion, and forming a first inverted-F antenna with the first radiation portion;

a third radiation portion, coupled to the fining tune metal portion, extending in the same direction of the second radiation portion, and form a second inverted-F antenna with the first radiation portion; and a transmission cable, coupled to one of the first radiation portion and the fine tuning metal portion.

14. The electronic device as claimed in claim 13, wherein when the transmission cable feeds in signals from the first radiation portion, the first radiation portion and the ground portion form a slot antenna.

15. The electronic device as claimed in claim 14, wherein the area of the fine tuning metal portion is used for adjusting the impedance matching of the slot antenna.

16. The electronic device as claimed in claim 14, wherein the operating bandwidth of the slot antenna is from 5 GHz to 6 GHz.

17. The electronic device as claimed in claim 13, wherein when the transmission cable feeds in the signals from the fine tuning metal portion, the fine tuning metal portion, the first radiation portion, and the ground portion form a slot flat antenna.

18. The electronic device as claimed in claim 17, wherein the area of the fine tuning metal portion is used for adjusting the impedance matching of the slot flat antenna.

19. The electronic device as claimed in claim 17, wherein the operating bandwidth of the slot flat antenna is from 5 GHz to 6 GHz.

20. The electronic device as claimed in claim 13, wherein the extensions of the second radiation portion and the third radiation portion are parallel with each other.

21. The electronic device as claimed in claim 20, wherein the difference in the lengths of the second radiation portion and the third radiation portion is based on up to between 1 to 2 percent more or less than the average wavelengths of the signals transmitted and received by the second radiation portion and the third radiation portion.

22. The electronic device as claimed in claim 13, the operating bandwidth of the first inverted-F antenna and the second inverted-F antenna is from 2.2 GHz to 2.6 GHz.

23. The electronic device as claimed in claim 13, wherein the transmission cable is a mini coaxial cable.

24. The electronic device as claimed in claim 13, wherein the transmission cable is connected between the first end and the second end of the first radiation portion.

* * * * *